US006547418B1

(12) United States Patent
Hsu

(10) Patent No.: US 6,547,418 B1
(45) Date of Patent: Apr. 15, 2003

(54) STRUCTURE OF TUBE LAMP

(76) Inventor: Yen Chuan Hsu, No. 91, Hsueh Fu Rd., Hsinchu City (TW)

( * ) Notice: Subject to any disclaimer, the term of this patent is extended or adjusted under 35 U.S.C. 154(b) by 0 days.

(21) Appl. No.: 09/984,691

(22) Filed: Oct. 31, 2001

(51) Int. Cl.[7] ..... F21V 21/00
(52) U.S. Cl. ..... 362/249; 362/124; 362/252; 362/806
(58) Field of Search ..... 362/223, 240, 362/249, 252, 189, 806, 124

(56) References Cited

U.S. PATENT DOCUMENTS 3,551,723 A * 12/1970 Van Groningen ..... 313/249
4,521,835 A * 6/1985 Meggs et al. ..... 362/184
4,908,743 A * 3/1990 Miller ..... 362/238

* cited by examiner

*Primary Examiner*—Sandra O'Shea
*Assistant Examiner*—Guiyoung Lee
(74) *Attorney, Agent, or Firm*—Dennison, Schultz & Dougherty

(57) ABSTRACT

An improved structure of tube lamp comprises a plastic tube having a power supply wire inside the tube and a plurality of parallel connected light bulb sets, wherein the light bulb sets consist of a plurality of serially connected light bulbs; a thicker metal wire is disposed inside the tube, is bended as desired and parallels the power supply wire, whereby the tube lamp is easily bended into a different model without any assistant frame. For any purpose, e.g. advertisements or festivals, construction is facilitated, cost is reduced and reusability is enhanced.

6 Claims, 10 Drawing Sheets

STRUCTURE OF TUBE LAMP

BACKGROUND OF THE INVENTION

1. Field of the Invention

The invention is an improved structure of tube lamp at substantially lowered cost and offers various models. It is used for any purpose, e.g. advertisements, shop signs, festivals and decorations.

2. Descriptions of the Prior Art

A general shop sign is not easily modified upon its manufacturing process being completed and thus unable to meet changing marketing demand. To overcome this defect, a traditional soft tube lamp includes a plastic tube having a power supply wire inside and multiple parallel connected light bulb sections each light bulb sections includes multiple serially connected light bulbs at intervals. As shown in FIG. 1, before the soft tube lamp A being bended into different models, a iron frame B with the specific shape is made, welded and roast painted. Further, many plastic ropes C are needed to attach the soft tube lamp A to the iron frame B. Therefore, the manufacturing costs are increased due to much more time, work and materials.

To reduce the aforesaid manufacturing costs, a low-price and simple lighting equipment was provided. The equipment includes a plate body, lighting tubes and fixing stand. The area from the outer diameter to the inner diameter that around the fixed plate body is curved inward becomes concave shape. From the bottom of the concave shape, cutting the body of concave with same interval upward and bending upward become fixing stripe, even the lighting tube must be set in concave shape and fixed by fixed stripes. The lighting equipments cannot do without the fixed plate body, so manufacturing cost is still high. Besides, the equipment is completed by the plastic rope and the fixed plate body being integrated, the lighting tube set being disposed in the concave of the fixed plate body and being fixed with stripes. Once completed, the equipment is not modified easily and accordingly lacks of mobility. Moreover, art skills are necessary if modification is desired. Accordingly, there is room for improving the structure of tube lamp.

SUMMARY OF THE INVENTION

A primary purpose of the invention is providing an improved tube lamp structure without a specific frame to reduce substantially human intervention and manufacturing costs.

Another purpose of the invention is providing an improved tube lamp structure, which is bended into diversified outlooks.

To achieve the above purpose, the improved structure of tube lamp of the invention includes one plastic tube having a power supply wire and a plurality of parallel connected light bulb sets, each light bulb sets consist of a plurality of serially connected light bulbs; a bendable thicker metal wire is disposed inside the tube lamp, and parallels the power supply wire, whereby the tube lamp is easily bended into a different model without any assisting frame. For any purpose, e.g. advertisement or entertainment or festivals, the present invention offers easy construction, cost reduction, reusability and flexibility.

The present invention will be apparent after reading the detailed description of the preferred embodiment thereof in reference to the accompanying drawings.

BRIEF DESCRIPTIONS OF THE DRAWINGS

Figure 7A:
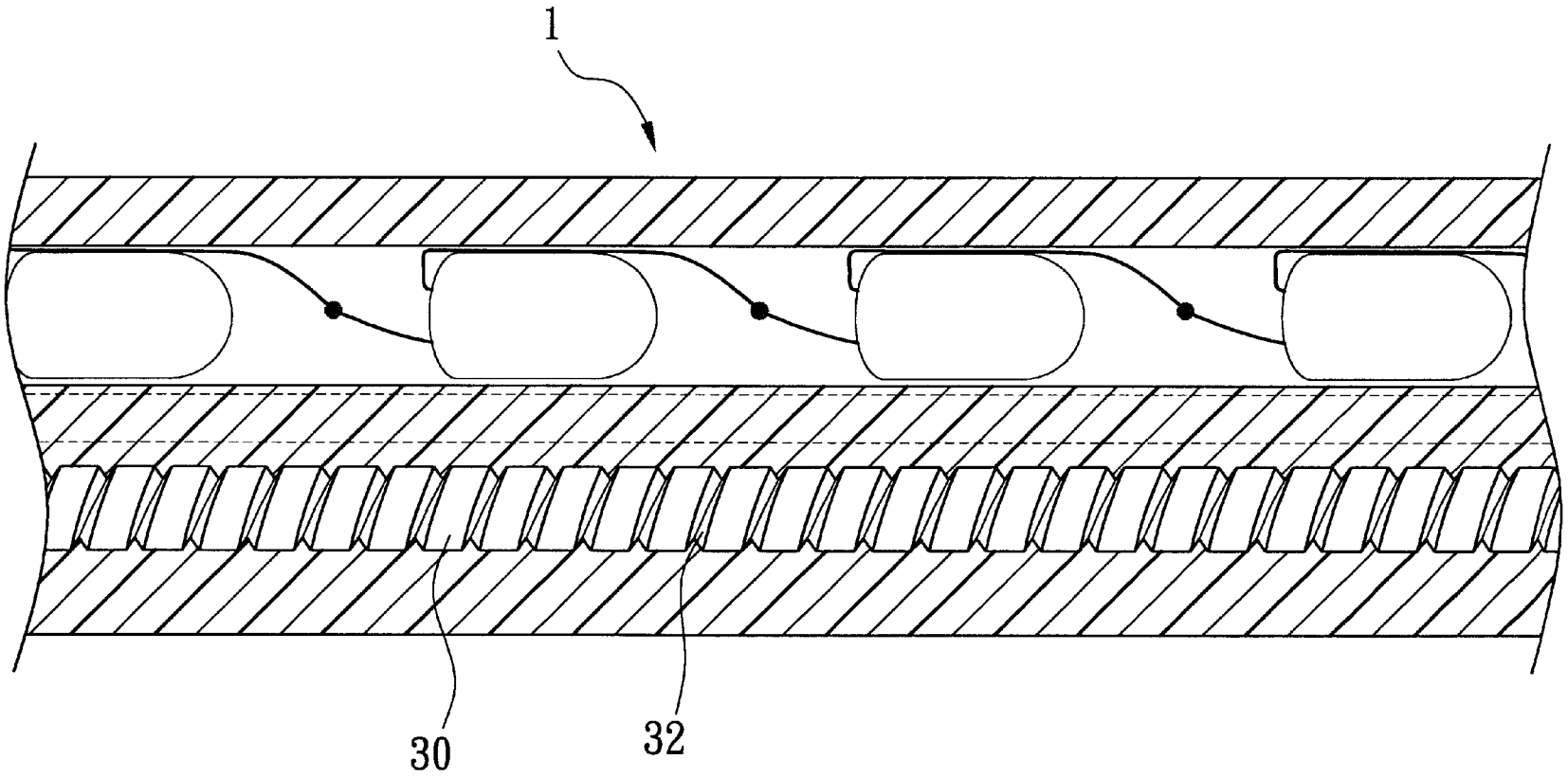
Figure 7B:
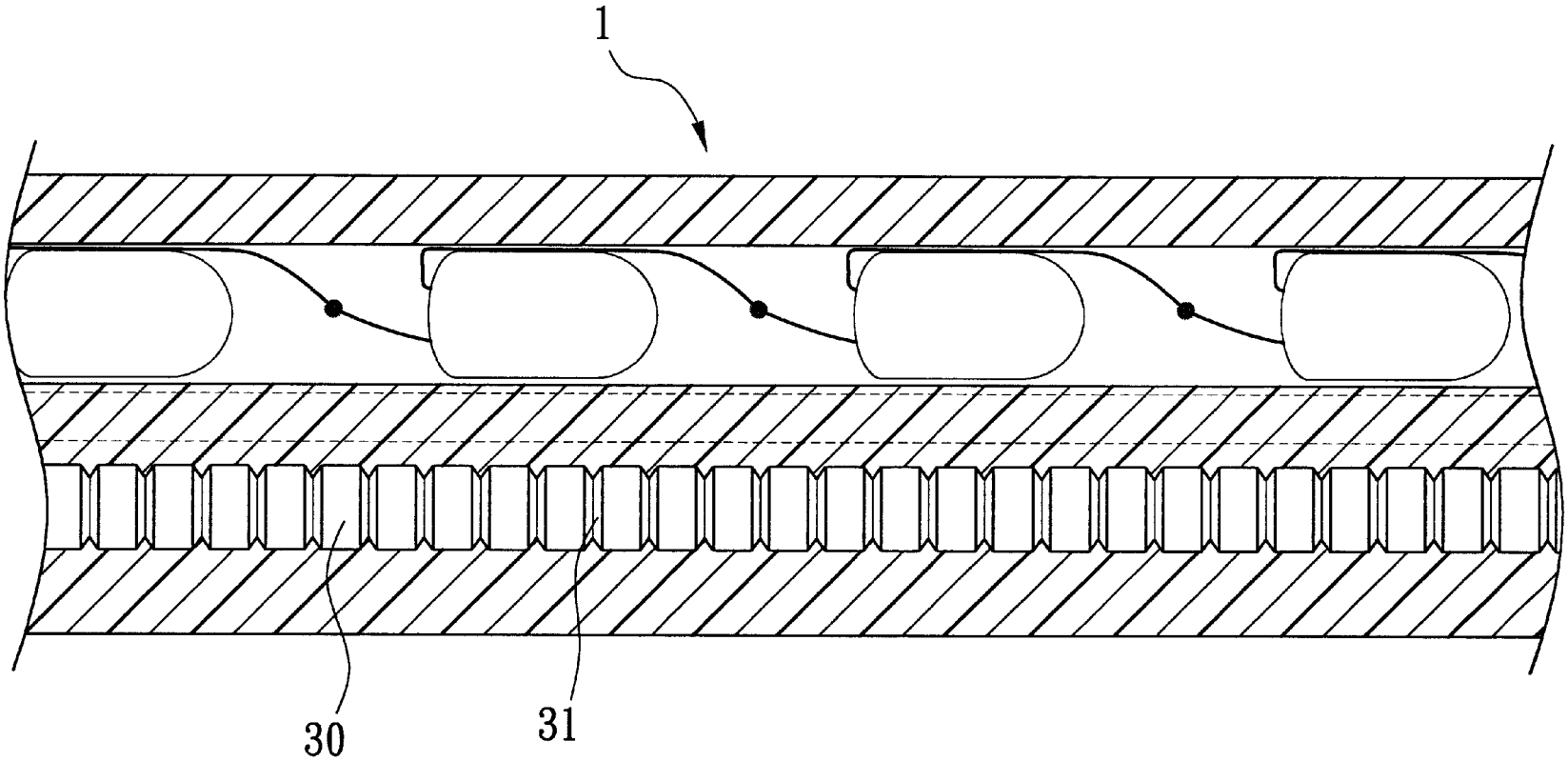
Figure 8:
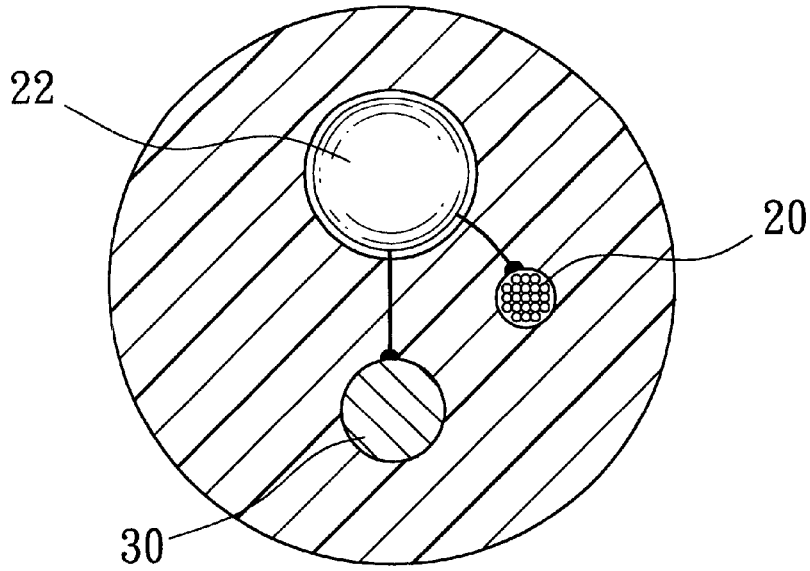
Figure 9:
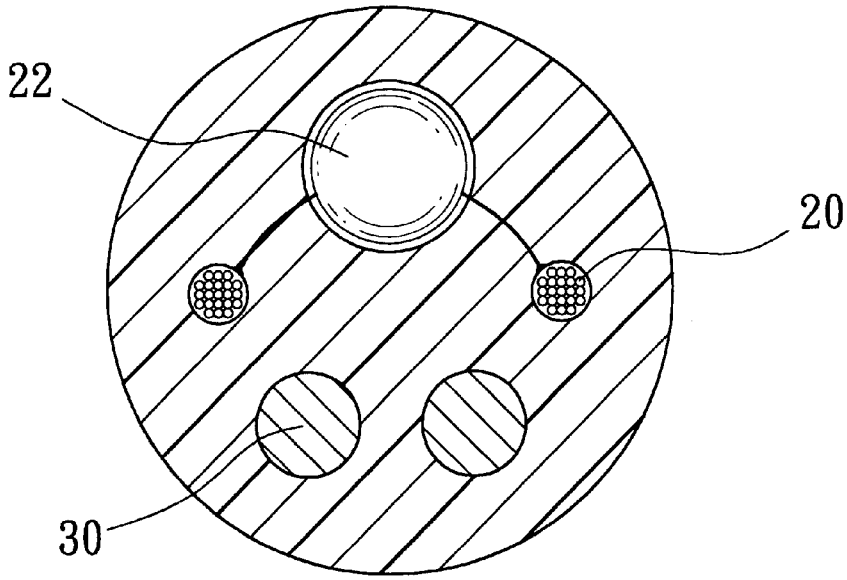
Figure 10:
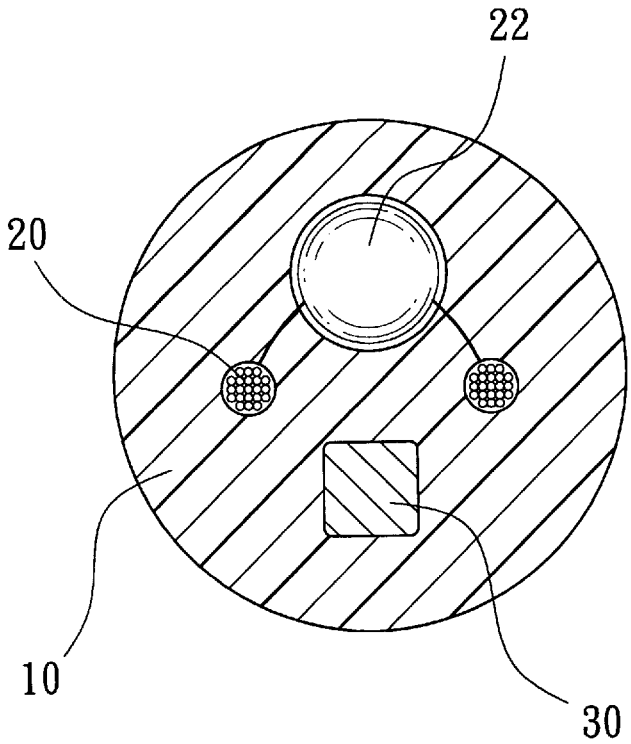
Figure 11:
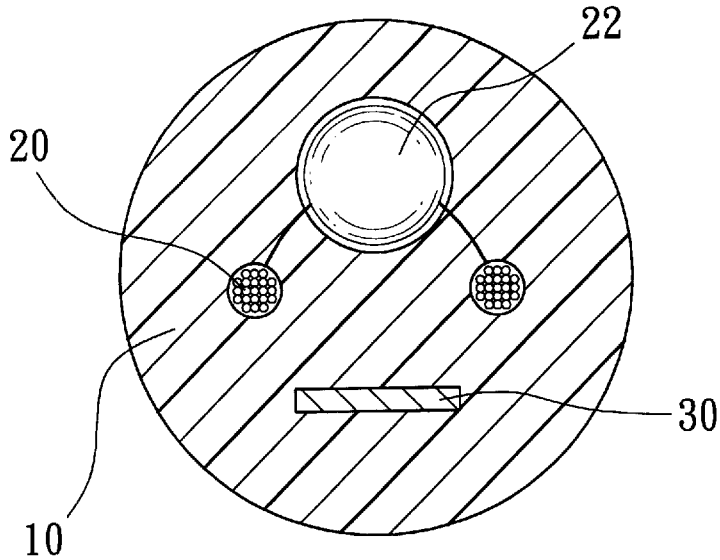

FIG. 7*a* is a diagram showing the metal wire with threads according to the invention;

FIG. 7*b* is a diagram showing the metal wire with recesses according to the invention;

FIG. 8 is a diagram showing the metal wire used as power supply ground wire according to the invention;

FIG. 9 is a diagram showing multiple metal wires disposed inside the tube of the invention;

FIG. 10 is a diagram showing the metal wire of an application of the invention; and FIG. 11 is a diagram showing the metal wire of another application of this invention.

DETAILED DESCRIPTIONS OF PREFERRED EMBODIMENTS

Figure 1:
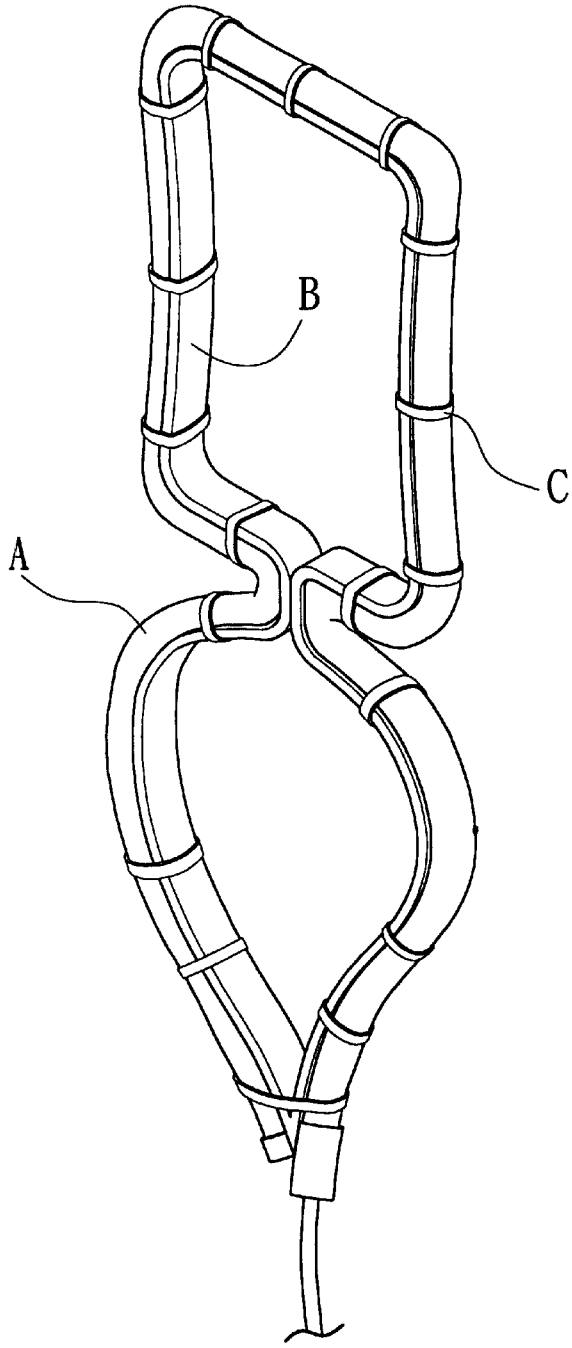
Fig. 1 (PRIOR ART)
FIG. 1 is a perspective view showing a traditional lamp.
Figure 2:
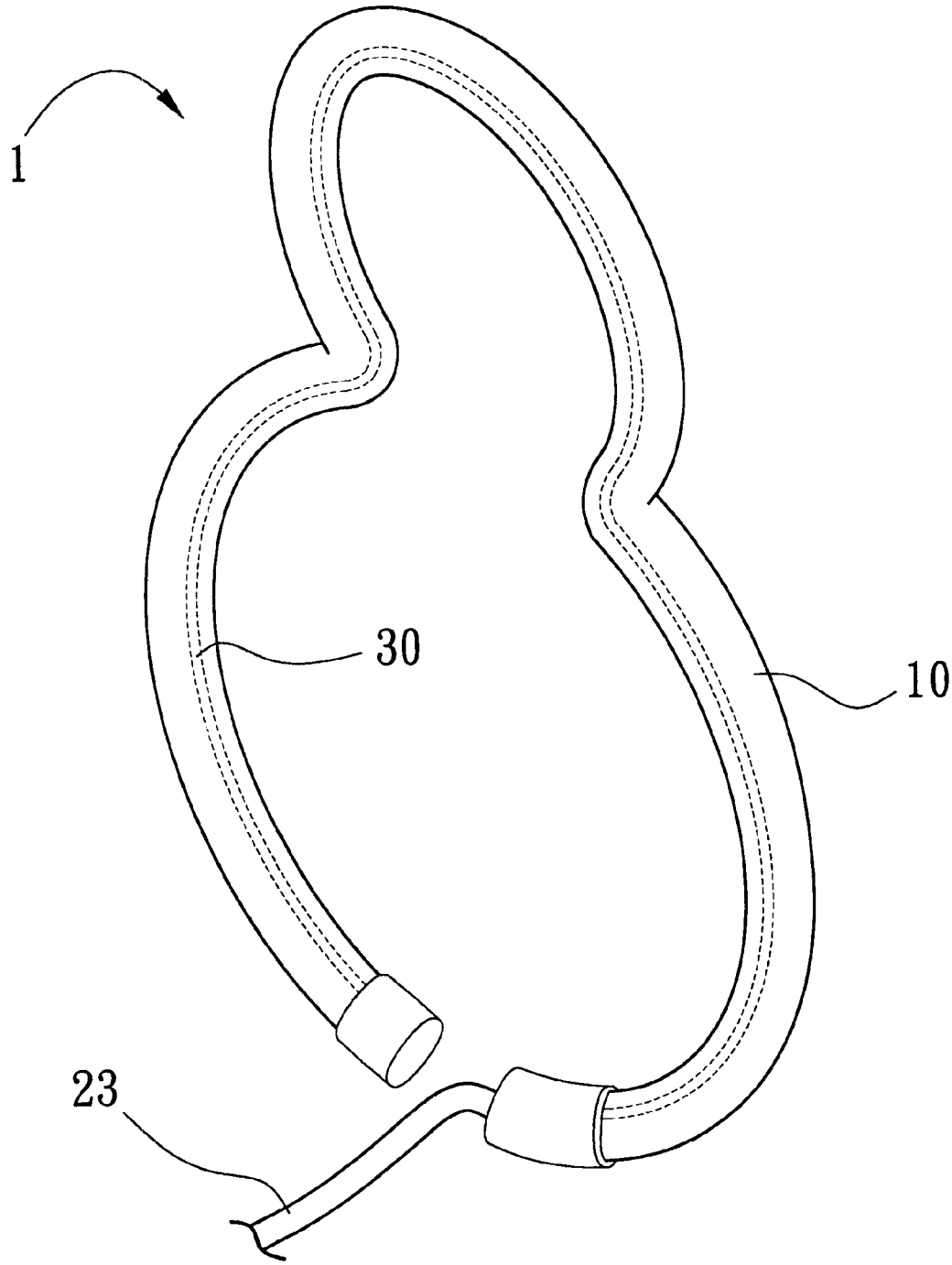
FIG. 2 is a perspective view showing an embodiment according to the present invention.
Figure 4:
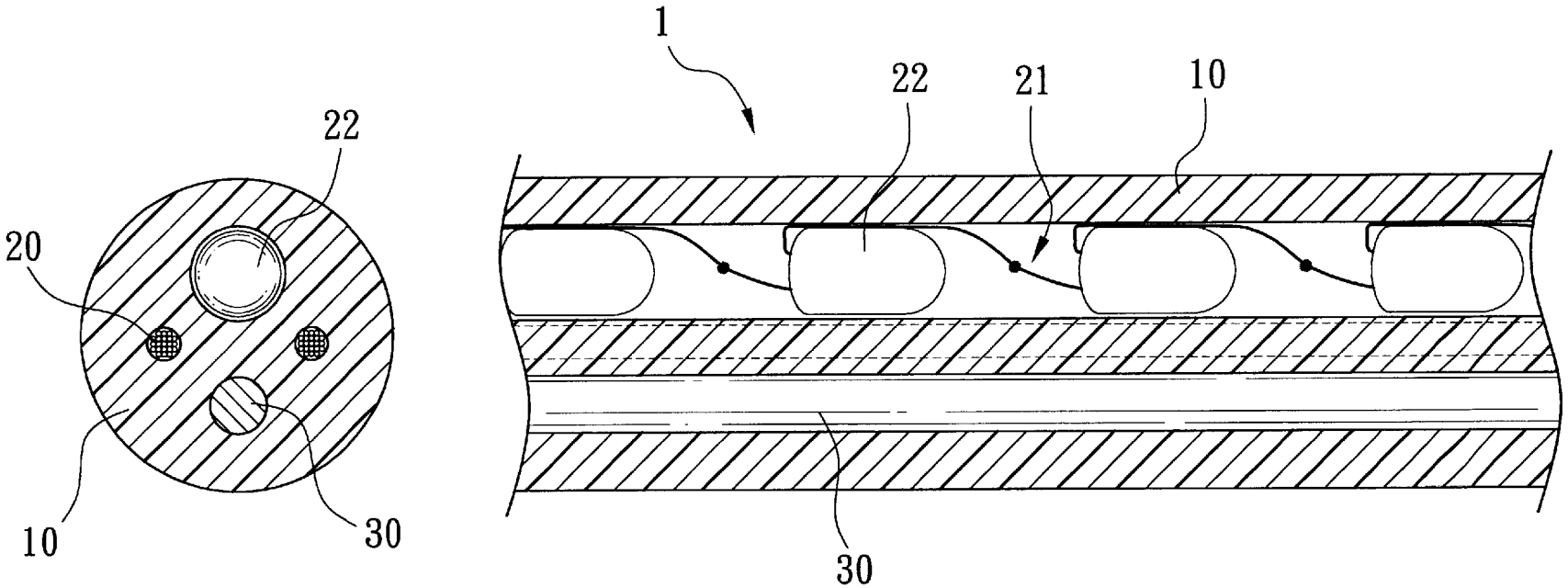
FIG. 4 is an exploded view illustrating a part of the embodiment according to the invention.

Please refer to FIG. 2 and FIG. 4. The tube lamp 1 of the present invention comprises a plastic tube 10 and a thicker metal wire 30, wherein:

the plastic 10 is a PVC tube having a power supply wire 20 inside the tube and a plurality of parallel connected light bulb sets 21, each light bulb set comprising a plurality of serially connected mini light bulbs 22.

The metal wire 30 is a flexible steel wire or copper wire with a thick diameter, is disposed inside the plastic tube 10, and parallels the power supply wire .

Figure 3:
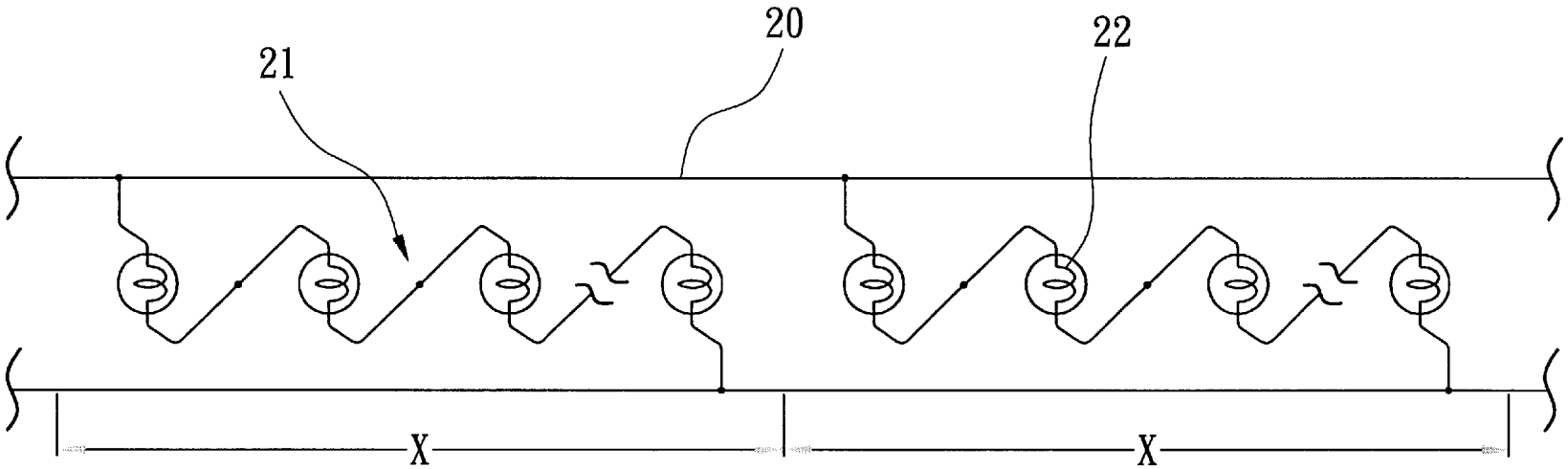
FIG. 3 is a diagram illustrating the internal loop of the embodiment according to the invention.

Referring to FIG. 3, one meter is the best length for each light bulb set 21 consisting of serially connected mini light bulbs 22. Each meter including mini light bulbs 22 is parallel connected with the power supply wire 20, thereby the tube lamp 1 is completed. When used, the tube lamp is cut for its appropriate total length. The tube lamp has one end sealed with a cover and the other end provided with the power supply wire 20, which is connected to the power supply wire 23 with a plug. Mini light bulbs 22 inside the tube lamp 1 turn on if power supply is provided through a plug.

Since the tube lamp 1 is completed by each meter tube being parallel connected, the failure due to any one of mini light bulbs 22 affects the local light bulb set but does not affect the normal operation of the tube lamp 1. According to the invention, the tube lamp 1 is flexible and bended as desired. Further, the tube lamp 1 comprising the thicker metal wire 30 for the remodeling of bended tube lamp to facilitate constructions and to save costs for any assisting frame.

Figure 5:
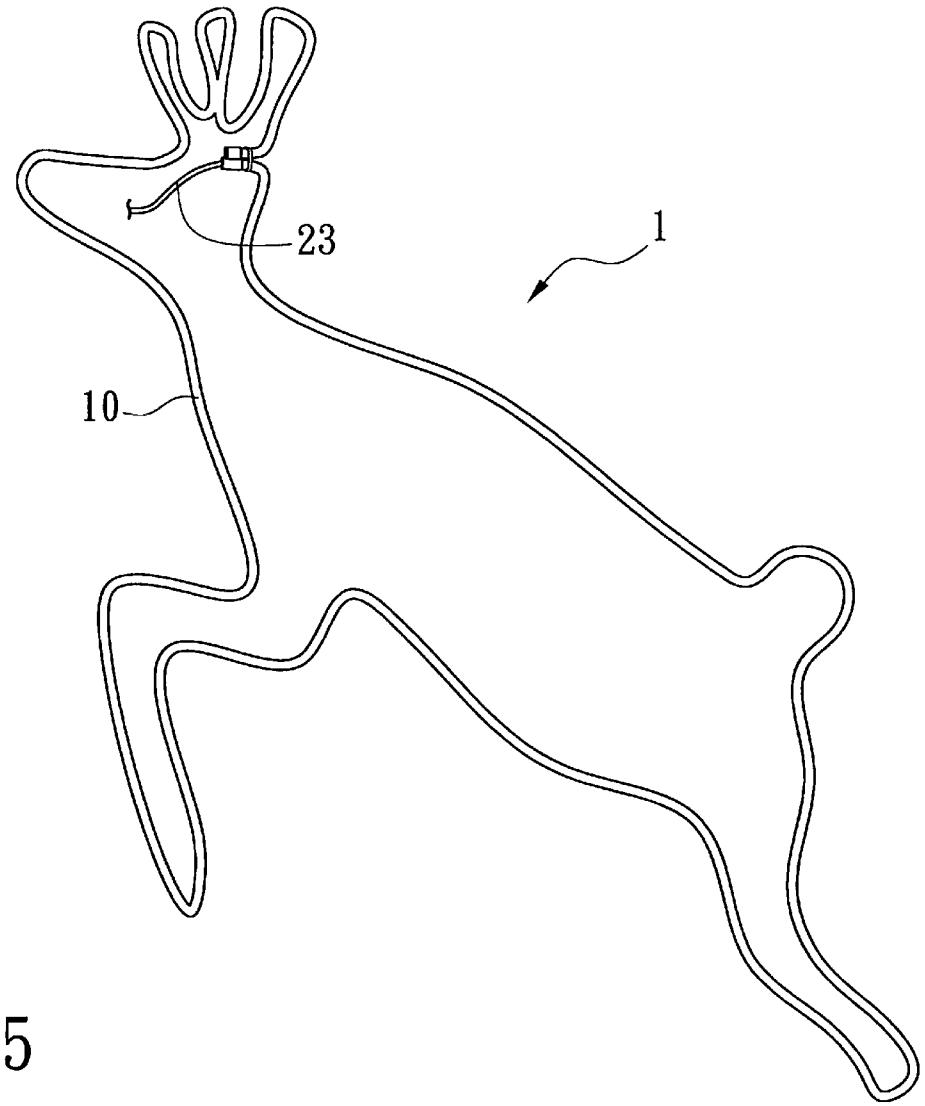
FIG. 5 is a diagram of the status of an application according to the present invention.

With a general users' manual, it is up to any user to bend the tube lamp into any shape, e.g. a deer as shown in FIG. 5.

Figure 6:
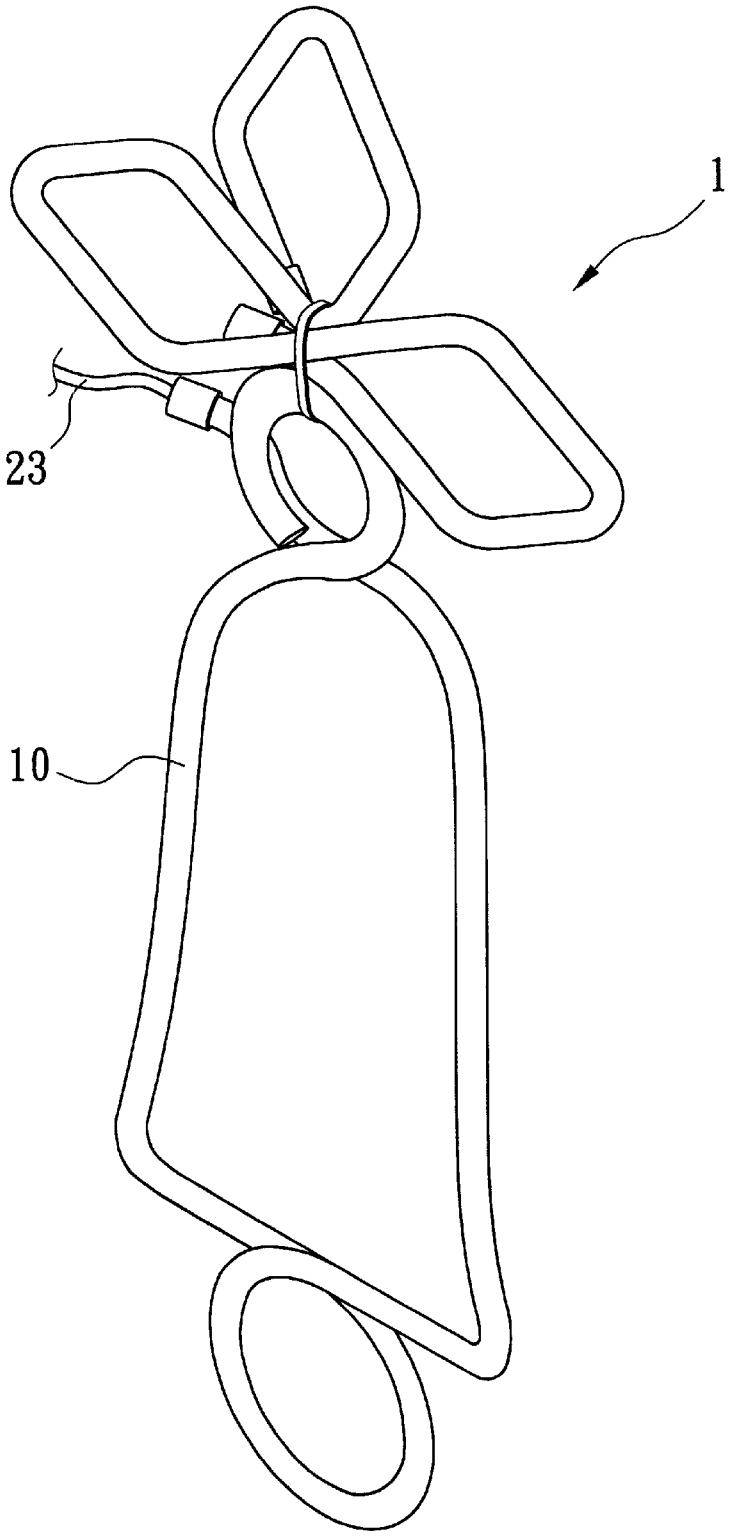
FIG. 6 is a diagram of the status of another application according to the invention.

If outlook change is considered, the tube lamp is re-bended into another shape, e.g. a bell as shown in FIG. 6. Compared with the traditional tube lamp, the tube lamp 1 is always reused and easily bended into any desired shape anytime.

Referring to FIG. 7*b*, the metal wire 30 has a engaging section 31, e.g. recesses, at intervals on the peripherals of the metal wire 30 for tighter binding to the plastic tube 10, and more flexibility when the lamp being bended. If necessary, the engaging sections are concave or protruding threads 32 on the surface of the metal wire 30 as FIG. 7*a*.

The-tube lamp 1 of the invention plugs in the power supply of 110 volts or 220 volts; light bulb can be replaced by Light Emitting Device, i.e. LED (not shown.) As shown in FIG. 8, the metal wire 30 inside the tube lamp is used for the power supply wire 20 of the tube lamp (a ground wire.) As shown in FIG. 9, multiple metal wires 30 are disposed inside the plastic tube 10 for lower chances of a single metal wire broken, better shape-maintaining or longer duration.

Referring to FIG. 10 and FIG. 11, the metal wire 30 inside the tube lamp is rectangle-like or flat-like shape, which is different from the traditional round metal wire. The traditional wire may move when bended, and increases the difficulty of remodeling of the bended tube lamp. The rectangle or flat metal wire is used, whereby when the tube is bended the wire does not move, light bulbs 22 are in the same directions, the remodeling of bended tube lamp 1 is facilitated.

Based on the above, the invention offers diversified types for any purpose in easier construction, lower cost and better flexibility.

While the preferred embodiments of the invention have been set forth for the purpose of disclosure, modifications of the disclosed embodiments of the invention as well as other embodiments thereof occur to those skilled in the art. Accordingly, the appended claims are intended to cover any embodiment which does not depart from the spirit and scope of the invention.

What is claimed is:

1. A tube lamp structure comprising:

a plastic tube, a power supply wire and a plurality of light bulb sets parallel connected to said power supply wire with said power supply wire and light bulb sets disposed inside said plastic tube and each of said light bulb sets including a plurality of serially connected light bulbs, a bendable metal wire thicker than said power supply wire disposed in said plastic tube and parallel to said power supply wire and wherein said plastic tube is a PVC tube and recesses are disposed at intervals on said metal wire.

2. A tube lamp structure as claimed in claim 1, wherein threads are disposed on the surface of said metal wire.

3. A tube lamp structure as claimed in claim 1, wherein the metal wire is used for the power supply ground wire of the tube lamp.

4. A tube lamp structure as claimed in claim 1, wherein multiple metal wires are disposed inside the plastic tube.

5. A tube lamp structure as claimed in claim 1, wherein the metal wire has a rectangle-like sectional area.

6. A tube lamp structure as claimed in claims 1, wherein the metal wire has a flat-like sectional area.

* * * * *